United States Patent [19]

Nückel et al.

[11] 4,408,524

[45] Oct. 11, 1983

[54] DEVICE FOR LOCKING AND ALIGNING PRINTING NUMERAL ROLLS AND A CONTROL CYLINDER

[75] Inventors: Klaus Nückel, Mülheim am Main; Manfred Schleuchardt, Offenbach am Main, both of Fed. Rep. of Germany

[73] Assignee: Postalia GmbH, Berlin, Fed. Rep. of Germany

[21] Appl. No.: 403,792

[22] Filed: Jul. 30, 1982

Related U.S. Application Data

[63] Continuation-in-part of Ser. No. 176,054, Aug. 7, 1980, abandoned.

[30] Foreign Application Priority Data

Aug. 7, 1979 [DE] Fed. Rep. of Germany ..... 2932425

[51] Int. Cl.[3] ..... B41J 1/60

[52] U.S. Cl. ..... 101/110

[58] Field of Search ..... 101/109–110, 101/111, 91, 99, 75, 85, 45; 400/144.2, 138–139; 235/117, 132 R

[56] References Cited

U.S. PATENT DOCUMENTS

| | | | |
|---|---|---|---|
| 2,715,998 | 8/1955 | Stanley | 235/117 |
| 3,363,547 | 1/1968 | Thut et al. | 101/110 X |
| 3,589,281 | 6/1971 | Woodhead | 101/110 X |
| 3,823,666 | 7/1974 | Hanson | 101/45 X |
| 3,918,361 | 11/1975 | Malavazos et al. | 235/132 R |
| 3,965,815 | 6/1976 | Lupkas et al. | 101/91 |
| 3,978,457 | 8/1976 | Check, Jr. et al. | 101/91 X |
| 4,050,374 | 9/1977 | Check, Jr. et al. | 101/91 |
| 4,140,054 | 2/1979 | Martin | 101/91 |

*Primary Examiner*—E. H. Eickholt

*Attorney, Agent, or Firm*—Herbert L. Lerner; Laurence A. Greenberg

[57] ABSTRACT

Device for locking and aligning a printing numeral roll and a control cylinder for internal counters in franking and value stamping machines, including a printing cylinder shaft, a shaped part disposed on the printing cylinder shaft, a toothed shaped part gear supported on the shaped part, a control cylinder shaft opposite the printing cylinder shaft, a toothed control disc gear being fixed on the control cylinder shaft and having a concave recess formed in the periphery thereof in which the shaped part gear is freely rotatable in a rest position, an extension disposed on the control disc gear, the control cylinder being rotatably supported on the extension, sprockets disposed on the control cylinder being settable by rotation of the shaped part gear in the rest position, a rack at least partially disposed in the printing cylinder shaft for setting the numeral roll in the rest position, the teeth of the control disc gear being engageable with the teeth of the shaped part gear for locking the control cylinder and blocking changing of the setting of the control cylinder sprockets in a denomination printing position, a slider guidable in the printing cylinder shaft, an angle lever connected to the slider for aligning and securing the numeral roll against change in the denomination printing position and for releasing the numeral roll in the rest position, and a cam for moving the slider between the positions.

7 Claims, 1 Drawing Figure

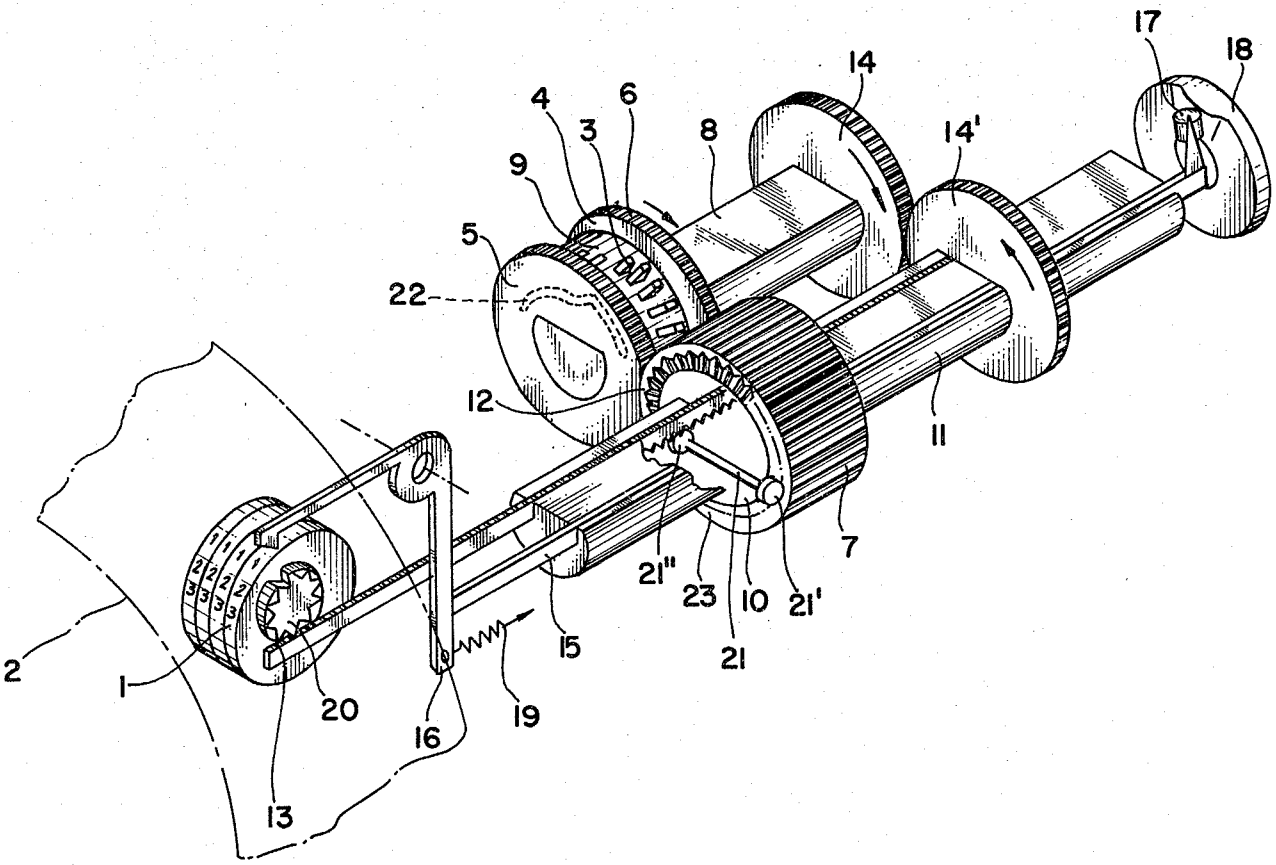
18
17
14'
14
8
6
3
4
9
5
22
12
11
7
21'
10
21
23
21"
15
19
16
20
13
1
2

DEVICE FOR LOCKING AND ALIGNING PRINTING NUMERAL ROLLS AND A CONTROL CYLINDER

This application is a continuation-in-part of application Ser. No. 176,054, filed Aug. 7, 1980 now abandoned.

The invention relates to a device for locking and aligning printing numeral rolls and control cylinder devices for internal counters in franking and value stamping machines.

Franking and value stamping machines have manually operable setting elements for the printing numeral rolls. In this operation, the sprockets of a control cylinder, which control an adding or subtracting counter are set, besides the numeral rolls for the denomination printing. To prevent changing the sprockets of the control cylinder and of the numeral rolls during the printing operation, such as by touching the setting elements or by direct action on the numeral rolls for instance, locking devices are necessary. In addition, devices are required for parallel alignment of the numeral rolls during the printing.

It is accordingly an object of the invention to provide a device for locking and aligning printing numeral rolls and a control cylinder for franking and value stamping machines which overcomes disadvantages of the heretofore known devices of this general type by providing a mechanically reliable locking and aligning device with a low parts count.

With the foregoing and other objects in view there is provided, in accordance with the invention, a device for locking and aligning a printing numeral roll and control cylinder devices for internal counters in franking and value stamping machines, comprising a printing cylinder shaft, a shaped part disposed on the printing cylinder shaft, a toothed gear supported on the shaped part, a control cylinder shaft opposite the printing cylinder shaft, a toothed control disc gear being fixed on the control cylinder shaft and having a concave recess formed in the periphery thereof in which the shaped part gear is freely rotatable in a rest position, an extension disposed on the control disc gear, the control cylinder being rotatably supported on the extension, sprockets disposed on the control cylinder being settable by rotation of the shaped part gear in the rest position, a rack at least partially disposed in the printing cylinder shaft for setting the numeral roll in the rest position, the teeth of the control disc gear being engageable with the teeth of the shaped part gear for blocking changing of the setting of the control cylinder sprockets in a denomination printing position, a slider guidable in the printing cylinder shaft, an angle lever connected to the slider for aligning and securing the numeral roll against change in the denomination printing position and for releasing the numeral roll in the rest position, and a cam for moving the slider between the positions.

In accordance with another feature of the invention, the control cylinder comprises a gear and a tooth shifting cage.

In accordance with a further feature of the invention, the control cylinder includes a gear, the control cylinder gear, control disc gear and shaped part gear having equal pitch circle diameters.

In accordance with an added feature of the invention, the width of the teeth of the shaped part gear is substantially equal to the combined width of the control disc gear and the control cylinder.

In accordance with an additional feature of the invention, the control cylinder gear is shiftable relative to the control disc gear in steps corresponding to the tooth pitch of the control cylinder sprockets.

In accordance with yet another feature of the invention, there is provided a roller fastened to the slider running on the cam.

In accordance with a concomitant feature of the invention, there is provided a tension spring biased against movement of the angle lever.

Other features which are considered as characteristic for the invention are set forth in the appended claims.

Although the invention is illustrated and described herein as embodied in a device for locking and aligning printing numeral rolls and a control cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIGURE of the drawing which is a diagrammatic perspective view of the parts of a franking machine essential for the invention.

Referring now particularly to the single FIGURE of the drawing, it is seen that a control disc gear 5 is fixedly disposed on a control cylinder shaft 8. Disposed on an extension of the control disc gear 5 is a control cylinder 4, a combination of a tooth shifting cage 9 and a gear 6.

Opposite the control disc gear 5 and gear 6 is a gear 7, which has lateral teeth 23 thereon and is supported on a shaped part 10 of the printing cylinder shaft 11. This shaped part 10 is secured against rotation relative to the printing cylinder shaft 11. The gears 5, 6 and 7 have the same teeth and the same pitch circle diameter. The gear 7 is constructed in such a way that the width of its teeth corresponds at least to the width of the combination of the control disc gear 5 and the control cylinder 4. The control disc gear 5 further has a concave recess 12 without teeth.

In the rest position, during which a numeral roll 1 is set by a rack 13 and during which the sprockets 3 of the control cylinder 4 are set for an adding or subtracting counter by a cam 22 within the control cylinder 4, the gear 7 is in engagement with the gear 6 of the control cylinder 4 and is situated in the toothless recess 12 of the control disc gear 5.

A non-illustrated setting lever drives the gear 7 and acts through the gear 7 on the gear 6 and the rack 13. When the setting lever rotates the gear 7, the gear 6 rotates so that the sprockets 3 are pushed out by the cam 22. The control cylinder 4 and sprockets 3 serve to control non-illustrated adding and subtracting counters and have no effect on the rack 13. The function of the sprockets 3 is more fully described in U.S. Pat. No. 4,335,651. Furthermore, when the setting lever rotates the gear 7, one of the gears 21' on the gear drive 21 is rotated by the lateral teeth 23 which causes the other gear 21'' to rotate and push the rack 13 by engagement with teeth 13' on the underside of the rack 13, which in turn rotates the numeral roll 1 by engaging the setting wheel 20. In this way the numeral roll 1 is set and the individual sprockets 3 of the control cylinder 4 driven by the gear 6, are pushed-out in accordance with a chosen set value. Since the combination including the gear 6 and the tooth shifting cage 9 sits loosely on the extension of the control disc gear 5, it is possible to shift the gear 6 relative to the control disc gear 5 in steps which correspond to the pitch of the sprockets 3.

If a denomination printing action is triggered or the machine is started, the first tooth following the concave deformation 12 of the control disc gear 5 engages between two teeth of the gear 7 and causes a rigid connection between the control disc gear 5 and the gear 6, which makes it impossible to change the sprockets 3 and the rack 13. A gear 14 fixedly disposed on the control cylinder shaft 8 drives a gear 14' which in turn drives the printing cylinder shaft 11 and, in a manner not shown in detail, a printing cylinder 2.

In addition to the rack 13 for setting the numeral roll 1, a slider 15 is guided in the rotating printing cylinder shaft 11. One end of the slider 15 acts on an angle lever 16 which is pivotable about the hole shown therein, for aligning the numeral roll 1. The other end of the slider 15 has a roller 17 which makes contact with the cam 18. In the rest position of the franking or value stamping machine, the roller 17 makes contact with the highest point of the cam 18, whereby the slider 15 is moved in the direction of the printing cylinder 2. After the machine has started manually or by a motor engaging the gear 14, the roller 17 runs onto the flat surface of the cam 18, whereby the angle lever 16 is moved by a tension sprin 19 and the slider 15 is in turn moved by the angle lever 16 in the direction of the cam 18. Since the lever 16 is disposed at an angle on the slider 15, the tooth on the end of the angle lever 16 near the roll 1 thereby drops into a tooth of the setting wheel 20 of the numeral roll 1 and keeps the roll 1 aligned in the set position until, after one revolution, the high point of the cam 18 again moves the slider 15 in the direction of the printing cylinder 2.

There are claimed:

1. Device for locking and aligning a printing numeral roll and a control cylinder for internal counters in franking and value stamping machines, comprising a printing cylinder shaft, a shaped part disposed on said printing cylinder shaft, a toothed shaped part gear supported on said shaped part, a control cylinder shaft opposite said printing cylinder shaft, a toothed control disc gear being fixed on said control cylinder shaft and having a concave recess formed in the periphery thereof in which said shaped part gear is freely rotatable in a rest position, an extension disposed on said control disc gear, the control cylinder being rotatably supported on said extension; sprockets disposed on the control cylinder being settable by rotation of said shaped part gear in said rest position, a rack at least partially disposed in said printing cylinder shaft for setting the numeral roll in said rest position, the teeth of said control disc gear being engageable with the teeth of said shaped part gear for locking the control cylinder and blocking changing of the setting of said control cylinder sprockets in a denomination printing position, a slider guidable in said printing cylinder shaft, an angle lever connected to said slider for aligning and securing the numeral roll against change in said denomination printing position and for releasing the numeral roll in said rest position, and a cam for moving said slider between said positions.

2. Device according to claim 1, wherein the control cylinder comprises a gear and a tooth shifting cage.

3. Device according to claim 1, wherein the control cylinder includes a gear, said control cylinder gear, control disc gear and shaped part gear having equal pitch circle diameters.

4. Device according to claim 3, wherein the width of the teeth of said shaped part gear is substantially equal to the combined width of said control disc gear and the control cylinder.

5. Device according to claim 2, wherein said control cylinder gear is shiftable relative to said control disc gear in steps corresponding to the tooth pitch of said control cylinder sprockets.

6. Device according to claim 1, including a roller fastened to said slider running on said cam.

7. Device according to claim 1, including a tension spring biased against movement of said angle lever.

* * * * *